United States Patent [19]

Wernicke et al.

[11] 4,324,935

[45] Apr. 13, 1982

[54] SPECIAL CONDITIONS FOR THE HYDROGENATION OF HEAVY HYDROCARBONS

[75] Inventors: Hans J. Wernicke, Wolfratshausen; Claus Schliebener, Strasslach, both of Fed. Rep. of Germany

[73] Assignee: Linde Aktiengesellschaft, Wiesbaden, Fed. Rep. of Germany

[21] Appl. No.: 197,719

[22] Filed: Oct. 16, 1980

[30] Foreign Application Priority Data

Oct. 16, 1979 [DE] Fed. Rep. of Germany ..... 2941851

[51] Int. Cl.[3] ..... C10G 47/00; C10G 67/00

[52] U.S. Cl. ..... 585/314; 208/57; 208/61; 208/108; 208/143; 585/315; 585/324; 585/430; 585/648; 585/650

[58] Field of Search ..... 208/61, 57, 58, 108–112, 208/143; 585/417, 430, 650, 648, 314, 315, 324

[56] References Cited

U.S. PATENT DOCUMENTS

| | | | |
|---|---|---|---|
| 4,179,474 | 12/1979 | Beuther et al. | 585/650 X |
| 4,181,601 | 1/1980 | Sze | 208/143 |
| 4,188,281 | 2/1980 | Wernicke et al. | 208/89 X |
| 4,216,077 | 8/1980 | Chahvekilian et al. | 208/57 |
| 4,260,474 | 4/1981 | Wernicke et al. | 585/652 X |

*Primary Examiner*—Delbert E. Gantz
*Assistant Examiner*—G. E. Schmitkons
*Attorney, Agent, or Firm*—Millen & White

[57] ABSTRACT

For thermally cracking heavy liquid hydrocarbons to produce gaseous olefins comprising a catalytic hydrogenating pretreatment, a separation of the hydrogenation product into a lighter fraction and a heavier fraction; passing the heavier fraction at least in part to a thermal cracking step to produce normally gaseous olefins; and withdrawing the lighter fraction, the improvement wherein the hydrogenation is conducted within the shaded area of FIG. 2, whereby said lighter fraction has a higher octane number.

11 Claims, 2 Drawing Figures

SPECIAL CONDITIONS FOR THE HYDROGENATION OF HEAVY HYDROCARBONS

BACKGROUND OF THE INVENTION

This invention relates to the hydrogenation of heavy hydrocarbons, and especially to the hydrogenating pretreatment of heavy hydrocarbons before they are subjected to thermal cracking to produce normally gaseous olefins, wherein the hydrogenation product is separated into a lighter fraction and a heavier fraction; the heavier fraction is introduced at least in part to the thermal cracking step; and the lighter fraction is withdrawn as a product.

Light starting materials, i.e. hydrocarbons having a boiling point of below 200° C., e.g. naphtha, are especially suitable for the thermal cracking of hydrocarbons to produce normally gaseous olefins such as ethylene and propylene. Such starting materials lead to high cracking yields and result in only a small quantity of undesired by-products.

However, in view of the high demand for olefins, which may lead to a short supply and increase in price of the aforementioned advantageous starting materials, several attempts have been made through the years to develop processes which permit the utilization of higher-boiling starting materials.

When employing such higher-boiling charges, the olefin yield is reduced and the yield of liquid hydrocarbons boiling above 200° C. is increased. The proportion of the latter high-boiling fraction, which is difficult to treat in further operation, increases significantly with the boiling point of the starting material. In addition, further difficulties are encountered in that higher-boiling starting materials lead to increased formation of coke and tar. These products are deposited on the walls of the conduit elements, for example, pipelines and heat exchangers, thereby impairing heat transfer, and furthermore resulting in constrictions in cross section. It is therefore necessary to conduct a removal of these deposits more frequently than when using light hydrocarbons.

To solve this problem, it has been known to catalytically hydrogenate heavy hydrocarbons prior to thermal cracking. Thereby the content of those aromatic compounds leading to the undesirable cracked products is reduced in the starting material. Moreover, the starting material is also desulfurized. To further improve this conventional method, it has been suggested in assignee's allowed copending U.S. application Ser. No. 082,453, filed Oct. 9, 1979, incorporated by reference herein, that the hydrogenation product be separated into two fractions of differing boiling ranges and that only the heavy fraction be introduced into the thermal cracking step. The light fraction, boiling in the gasoline range, can be used, according to this process as gasoline owing to its relatively high degree of isomerization. However, the octane number of this light fraction is so low that catalytic reforming is required to raise the octane number for engine use.

SUMMARY OF THE INVENTION

An object of this invention is to provide a process of the type mentioned in the incorporated reference so that it can be operated under especially favorable economic conditions.

Upon further study of the specification and appended claims, further objects and advantages of this invention will become apparent to those skilled in the art.

These objects are attained by conducting the hydrogenation at temperatures of between 350° and 450° C., and within this range employing a particular hydrogenation temperature combined with a particular hydrogen partial pressure such that it falls within a specific area on a hydrogen partial pressure-temperature diagram, said area being delineated by the corner coordinates 350° C./5 bar; 350° C./15 bar; 400° C./40 bar; 450° C./100 bar; 450° C./20 bar; and 400° C./10 bar with substantially straight lines defining the boundary between the coordinates. In this connection, the hydrogen partial pressure is understood to mean the effective hydrogen partial pressure in the reactor, i.e. at the reaction temperature.

The rate of the hydrogenation reaction is conventional, the preferred range being about, on a rate per unit volume basis, 0.5 to 5, especially 0.8 to 2 liters of fluid per liter of solid catalyst material per hour.

As for the catalyst, any conventional hydrogenation catalyst may be used in the hydrogenation step, e.g. catalysts containing a base metal of groups VI–VIII of the periode table as the hydrogenation component on an acidic support, for example silica, alumina or an exchanged zeolite. It is preferred, however, to use catalysts with a hydrogenation component on a zeolitic support, like those disclosed in U.S. Pat. No. 4,188,281 of Wernicke et al., issued Feb. 12, 1980, incorporated by reference herein.

The thermal cracking of the higher-boiling components of the heavy hydrocarbons hydrogenated according to this invention leads to high olefin yields, approximating those of naphtha. Besides the high yield of valuable products, the proportion of relatively difficulty usable pyrolysis fuel oil boiling above 200° C., is reduced substantially. For example, the content of resultant pyrolysis fuel oil from cracked hydrogenated vacuum gas oil is below 25% by weight of the cracked products, and thus below the range of a conventional cracking of atmospheric gas oil. In the thermal cracking of a non-hydrogenated vacuum gas oil, in contrast thereto, up to 40% by weight of pyrolysis fuel oil is produced.

Surprisingly, it has been found when conducting the process of this invention that the fraction of the hydrogenation product boiling in the gasoline range represents a high-quality gasoline exhibiting engine-compatible properties and no longer requiring processing by catalytic reforming. It is assumed that this is due to the fact that during hydrogenation a large part of the monoaromatics present in the starting material and/or formed during the reaction from polyaromatics are reacted to short-chain substituted aromatics containing less than 10 carbon atoms. Such short-chain substituted monoaromatics are important for the high engine compatibility of the gasoline fraction.

In the context of the petroleum field, polyaromatics refer to condensed aromatic ring systems, e.g. naphthalene, whereas monoaromatics include not only mononuclear compounds such as benzene derivatives but also non-condensed polynuclear compounds such as diphenyl alkane and alkyl diphenyl. The hydrogenation is thus conducted under such conditions that the aromatic structure of the monoaromatics is substantially maintained, whereas aliphatic chains connected to aromatic rings may be shortened or substituted.

It is also possible selectively to obtain a kerosine fraction in the boiling range from about 180° to 230° C., representing a suitable turbine fuel.

The separation of the gasoline or kerosene fraction from the hydrogenation product is conventional, e.g. a distillation step.

It is especially advantageous to conduct the hydrogenation at temperatures of between 380° and 420° C. Under these conditions the process pressure is relatively low, thereby permitting the use of reactors having a low design pressure, such as are employed, for example, in hydrogenating desulfurizing processes.

In an especially advantageous embodiment of the process according to this invention, the heavier fraction of the hydrogenation product, boiling above the gasoline boiling range, is fractionated into an intermediate distillate fraction and into a hydrogenation residue. The intermediate distillate fraction, which can boil approximately in the range of between 200° and 340° C., is a suitable feed for an ethylene plant designed for naphtha or gas oil cracking. Thus, the flexibility of the usefulness of such plants can be increased when utilizing the process of this invention. The hydrogenation residue, comprising the components boiling above about 340° C., likewise represents a possible cracking feed. However, in existing ethylene plants designed for gas oil cracking, this residue is recycled into the hydrogenation reactor since the proportion of intermediate distillate is thereby increased and its quality as cracking feed is improved. The recycling step also raises the iso-/n-paraffin ratio in the gasoline fraction which, in turn, has a favorable effect on its engine properties.

The process of this invention not only makes it possible to increase the flexibility of usefulness of an olefin plant, but one can also vary the product properties after hydrogenation by varying the hydrogenation conditions within the aforementioned limits in such a way that simultaneously both an advantageous cracking feed and another valuable refinery product are produced.

DETAILED DESCRIPTION OF PREFERRED EMBODIMENT

Figure 1:
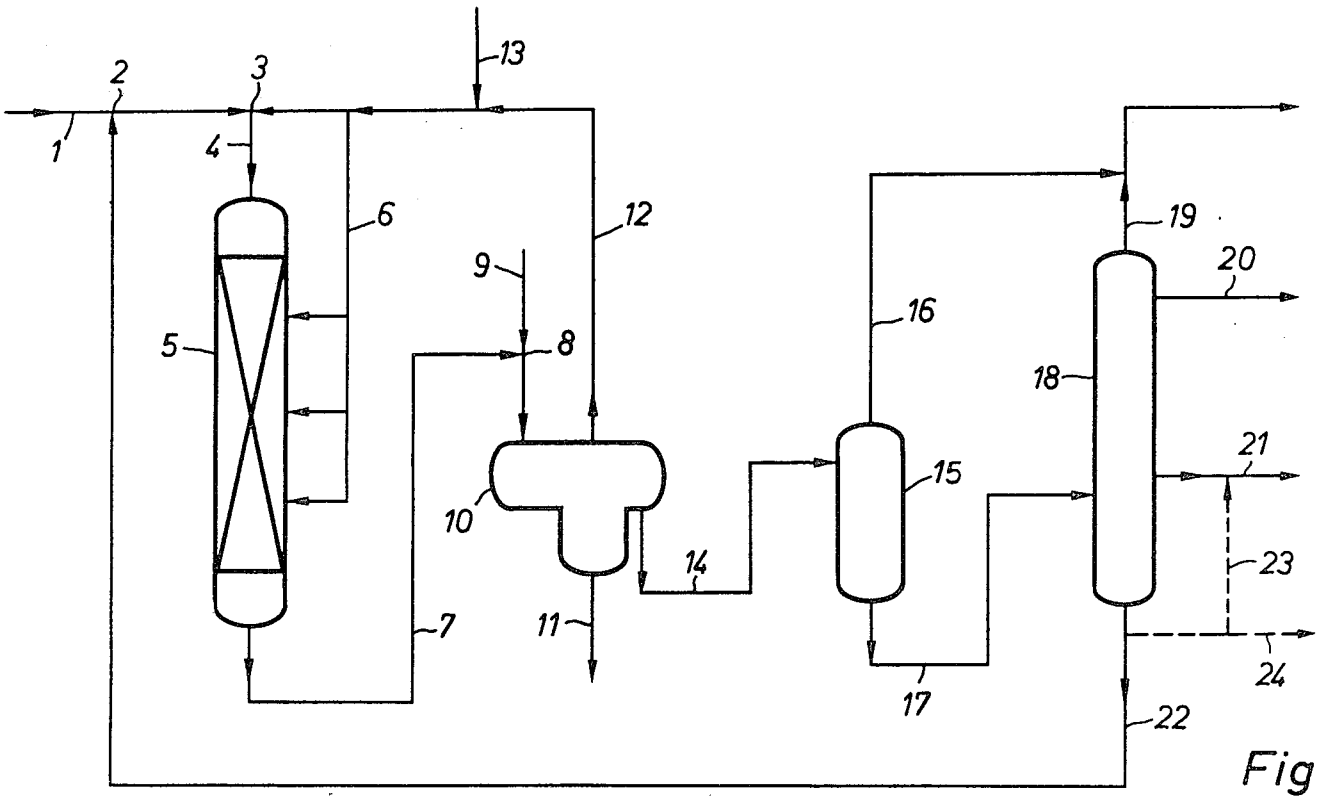
FIG. 1 is a schematic flow chart of a preferred embodiment of the process of this invention.

In the embodiment shown in FIG. 1, the fresh feed, for example a vacuum gas oil or a gas oil, is introduced via conduit 1, intermixed at 2 with a recycle oil and at 3 with hydrogenation hydrogen, and thereupon conducted via conduit 4 into the hydrogenation reactor 5. Hydrogenation takes place with the use of a hydrogenation catalyst active with respect to cracking but stable with respect to the high content of heterocycles in the feed. Suitable catalysts contain a base metal of Groups VI–VIII of the periodic table as the hydrogenation component on an acidic support, for example an exchanged zeolite. To control the temperature during the exothermic hydrogenation reaction, cold gas is introduced at suitable intermediate points, which gas is fed via conduit 6.

The hot hydrogenation product is withdrawn via conduit 7 and quenched at 8 with water fed via conduit 9. After cooling, the product passes into the decanter 10; from the sump of the decanter, condensed water as well as impurities contained therein, such as hydrogen sulfide or ammonia, are withdrawn via conduit 11. Gaseous reaction products consisting essentially of hydrogen are withdrawn via conduit 12, and after admixing fresh hydrogen via conduit 13, are again mixed at 3 with fresh feed and recycled into the hydrogenation reactor 5.

The liquid hydrogenation product is discharged from decanter 10 via conduit 14 and expanded in phase separator 15, thus forming a gaseous fraction consisting of light components, which is withdrawn via conduit 16. The components remaining in the liquid phase are fed via conduit 17 into a distillation column 18 wherein an atmospheric distillation is conducted. During this step, a light fraction consisting of hydrocarbons of up to 4 carbon atoms in the molecule is withdrawn overhead via conduit 19, mixed with the gaseous products from conduit 16, and discharged as liquefied petroleum gas (LPG). Via conduit 20, a gasoline fraction is withdrawn at the upper zone of the column 18, which fraction can be utilized directly as motor fuel. An intermediate distillate is discharged via conduit 21 and fed to a thermal cracking step (not shown). The hydrogenation residue containing the components boiling above approximately 340° C. is withdrawn from the sump of the colum 18 via conduit 22 and recycled to the inlet of the hydrogenation reactor 5 where it is mixed at 2 with fresh feed. This fraction can, however, also be mixed with the intermediate distillate in conduit 21 and fed together therewith to a correspondingly designed thermal cracking stage (not shown). This process variation is indicated in the figure by the dashed-line conduit 23. However, the cracking of the hydrogenation residue can also be effected separately in a cracking furnace (not shown) designed for this purpose (conduit 24).

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

A vacuum gas oil is utilized as the feed having a boiling range of 340°–550° C., a density (at 30° C.) of 0.900 g/ml, and an average molecular weight of 326 g/mol. This feed analysis is 84.85% by weight carbon, 12.25% by weight hydrogen, and 2.73% by weight sulfur. The vacuum gas oil consists of 46.6% by weight of paraffins (P) and naphthenes (N) and contains 16.1% by weight of monoaromatics, as well as 37.3% by weight of polyaromatics.

The vacuum gas oil was hydrogenated by one pass through the reactor without recycling of the hydrogenation residue, but including recycle of excess hydrogen. The temperature was 395° C., the process pressure was 58 bar, the hydrogen partial pressure at the reactor inlet was 51 bar, and the rate per unit volume was 0.91 liter of fluid per liter of catalyst per hour. The hydrogen consumption was 145 $Nm^3$/ton of feed. The catalyst employed was a hydrogen-exchanged zeolite Y containing nickel and tungsten as hydrogenation-active components.

The hydrogenation product contained 2.1% by weight of hydrogen sulfide and ammonia, 4.5% by weight of LPG, 32.4% by weight of hydrocarbons having a boiling range of $C_5$-200° C., 28% by weight of hydrocarbons having a boiling range of 200°-340° C., and 33% by weight of hydrocarbons boiling above 340° C. The product properties of the three last-mentioned fractions are listed in the table set out below.

| | $C_5$-200° C. | 200-340° C. | >340° C. |
|---|---|---|---|
| Density (20° C.) g/ml | 0.73 | 0.83 | 0.89 |
| C % by weight | 86.99 | 86.61 | 86.62 |
| H % by weight | 13.00 | 13.29 | 12.99 |
| S ppm by weight | 76 | 1020 | 5250 |
| P + N % by weight | 64 | 68.0 | 61 |
| Monoaromatics % by weight | 36 | 22.5 | 20 |
| Polyaromatics % by weight | — | 9.5 | 19 |
| RON clear | 95 | | |

The intermediate distillate boiling between 200° and 340° C. is then conducted to a thermal cracking stage. Cracking was conducted at a steam dilution of 0.45 kg steam/kg intermediate distillate. The outlet temperature from the cracking zone was 860° C. The cracked product contained as the essential components 10.5% by weight of $CH_4$, 25% by weight of $C_2H_4$, 13.0% by weight of $C_3H_6$, 2.5% by weight of $C_4H_8$, and 35% by weight of $C_{5+}$-hydrocarbons.

The preferred hydrocarbon feedstocks for the process of this invention are all distillates and deasphalted fractions boiling above about 200° C. (at atmospheric pressure), e.g. gasoil (typical boiling range from about 200° to about 340° C.), vacuum gasoil (typical boiling range from about 340° to about 550° C.), deasphalted atmospheric or vacuum residues (boiling above about 340 resp. 550° C.), visbreaker distillates or coker distillates.

As is well known for a man skilled in the art, processes for the production of normally gaseous olefins in a thermal cracking step are not regarded to be efficient unless the yield of normally gaseous olefins is above about 30% (by weight) of the cracked feedstock. In many cases, ethylene as one of the most important chemicals in the petrochemical industry is the olefin which is desired most. Therefore, it is desirable usually to obtain at least about 20% (by weight) of ethylene, whereas the amount of cocurrently produced propylene may be smaller, e.g. about 10 to 15% (by weight).

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modification of the invention to adapt it to various usages and conditions.

Figure 2:
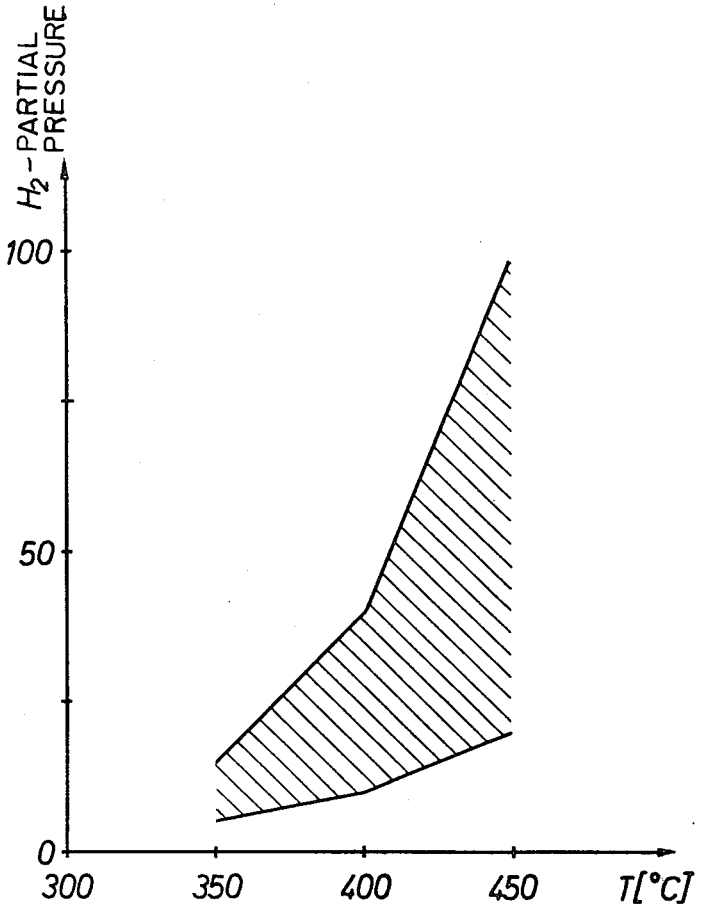
FIG. 2 shows the area within a hydrogen partial pressure-temperature diagram wherein the process of this invention is conducted.

What is claimed is:

1. In a process for the cracking of heavy liquid hydrocarbons comprising monoaromatics and polyaromatics, said process comprising a catalytic hydrogenating pretreatment of said heavy hydrocarbons, separating hydrogenation product into a lighter fraction containing the major portion of the monoaromatics and a heavier fraction; passing the heavier fraction at least in part to a thermal cracking step to produce normally gaseous olefins; and withdrawing the lighter fraction, the improvement wherein hydrogenation is conducted within the shaded area of FIG. 2, wherein at temperatures of between 350° and 450° C., the hydrogen partial pressure and the hydrogenation temperature are selected so that their values in a hydrogen partial pressure-temperature diagram lie within the area bounded by the curve having the corner coordinates 350° C./5 bar; 350° C./15 bar; 400° C./40 bar; 450° C./100 bar; 450° C./20 bar; and 400° C./10 bar, whereby said lighter fraction has a higher octane number.

2. A process according to claim 1, wherein the hydrogenation is conducted at between 380° and 420° C.

3. A process according to claim 1, wherein the heavier fraction consists of the components of the hydrogenation product boiling above 200° C.

4. A process according to claim 1, wherein the heavier fraction of the hydrogenation product is fractionated into an intermediate distillate fraction fed to the thermal cracking stage, and into a hydrogenation residue recycled into the hydrogenation.

5. A process according to claim 4, wherein the hydrogenation residue consists of the components of the hydrogenation product boiling above 340° C.

6. A process according to claim 1, wherein the hydrogenation products are fractionated into a lighter fraction being a gasoline boiling below about 180° C.; a kerosine fraction boiling between about 180° and about 230° C.; an intermediate distillate fraction; and a residue fraction, wherein the intermediate distillate fraction and/or the residue fraction are fed to the thermal cracking stage.

7. A process according to claim 1, wherein the lighter fraction is a gasoline fraction boiling below 200° C. and having a research octane number of at least 85.

8. A process according to claim 1, wherein the lighter fraction is a gasoline fraction boiling below 180° C. and having a research octane number of at least 85.

9. A process according to claim 1, wherein the heavy liquid hydrocarbons subjected to the hydrogenating treatment comprise a vacuum gas oil.

10. A process according to claim 9, wherein less than 25% by weight of the vacuum gas oil feed is formed into pyrolysis oil.

11. A process for catalytically hydrogenating heavy liquid hydrocarbon boiling above 200° C. comprising conducting the hydrogenation within the shaded area of FIG. 2, wherein at temperatures of between 350° and 450° C., the hydrogen partial pressure and the hydrogenation temperature are selected so that their values in a hydrogen partial pressure-temperature diagram lie within the area bounded by the curve having the corner coordinates 350° C./5 bar; 350° C./15 bar; 400° C./40 bar; 450° C./100 bar; 450° C./20 bar; and 400° C./10 bar, the resultant product containing a gasoline cut having a research octane number of at least 85 for direct use as motor fuel.

* * * * *